US010353413B2

(12) United States Patent
Kim

(10) Patent No.: US 10,353,413 B2
(45) Date of Patent: Jul. 16, 2019

(54) VOLTAGE GENERATION CIRCUITS, SEMICONDUCTOR DEVICES INCLUDING THE SAME, AND METHODS OF GENERATING VOLTAGES

(71) Applicant: SK hynix Inc., Icheon-si Gyeonggi-do (KR)

(72) Inventor: Byung Soo Kim, Icheon-si Gyeonggi-do (KR)

(73) Assignee: SK hynix Inc., Icheon-si, Gyeonggi-do (KR)

( * ) Notice: Subject to any disclaimer, the term of this patent is extended or adjusted under 35 U.S.C. 154(b) by 16 days.

(21) Appl. No.: 15/481,972

(22) Filed: Apr. 7, 2017

(65) Prior Publication Data

US 2018/0091120 A1 Mar. 29, 2018

(30) Foreign Application Priority Data

Sep. 28, 2016 (KR) ..... 10-2016-0125089

(51) Int. Cl.
*G05F 1/46* (2006.01)
*G05F 3/16* (2006.01)
*G05F 3/26* (2006.01)

(52) U.S. Cl.
CPC ..... *G05F 1/46* (2013.01); *G05F 3/16* (2013.01); *G05F 3/262* (2013.01)

(58) Field of Classification Search
None
See application file for complete search history.

(56) References Cited

U.S. PATENT DOCUMENTS 9,918,367 B1 * 3/2018 Scenini ..... H05B 33/0884
2008/0036708 A1 * 2/2008 Shirasaki ..... G09G 3/3233 345/76
2012/0013495 A1 * 1/2012 Rey-Losada ..... G01R 19/257 341/139
2012/0212251 A1 * 8/2012 Yanagishima ..... H03K 17/61 324/762.01
2014/0055031 A1 * 2/2014 Miyamoto ..... H05B 33/0809 315/82
2015/0048820 A1 2/2015 Schaffer et al.
2016/0094214 A1 * 3/2016 Liu ..... H02M 3/07 327/113
2016/0336976 A1 * 11/2016 Onishi ..... H04B 1/0475

FOREIGN PATENT DOCUMENTS

KR 100833624 B1 5/2008

* cited by examiner

*Primary Examiner* — Cassandra F Cox
(74) *Attorney, Agent, or Firm* — William Park & Associates Ltd.

(57) ABSTRACT

A voltage generation circuit includes a current source connected to a first node to generate a first internal current corresponding to a constant current, a comparison circuit generating a drive voltage whose level is controlled according to a voltage difference between the first node whose voltage level is controlled by the first internal current and a second node, and a charge supply circuit controlling an amount of charge supplied to the first and second nodes from a power supply voltage terminal according to a level of the drive voltage to generate a supply voltage.

20 Claims, 5 Drawing Sheets

VOLTAGE GENERATION CIRCUITS, SEMICONDUCTOR DEVICES INCLUDING THE SAME, AND METHODS OF GENERATING VOLTAGES

CROSS-REFERENCE TO RELATED APPLICATIONS

The present application claims priority under 35 U.S.C 119(a) to Korean Application No. 10-2016-0125089, filed on Sep. 28, 2016, which is herein incorporated by reference in its entirety.

BACKGROUND

1. Technical Field

Embodiments of the present disclosure relate to voltage generation circuits generating a stable supply voltage, semiconductor devices including the same, and methods of generating voltages.

2. Related Art

As semiconductor devices become more highly integrated, sub-micron design rules have been applied to the design of internal circuits of the semiconductor devices. A power supply voltage level for driving the semiconductor devices has been gradually lowered to operate the internal circuits designed with the sub-micron design rules at a high speed. Thus, a lot of effort has been focused on developing high performance semiconductor devices that stably perform internal operations with a low power supply voltage. In particular, voltage generated by the power supply voltage may easily fluctuate in spite of only small variations of the power supply voltage. Accordingly, it may be important to design circuits for generating stable voltages to realize high performance semiconductor devices.

SUMMARY

According to an embodiment, a voltage generation circuit is provided. The voltage generation circuit includes a current source connected to a first node to generate a first internal current corresponding to a constant current, a comparison circuit generating a drive voltage whose level is controlled according to a voltage difference between the first node whose voltage level is controlled by the first internal current and a second node, and a charge supply circuit controlling an amount of charge supplied to the first and second nodes from a power supply voltage terminal according to a level of the drive voltage to generate a supply voltage.

According to another embodiment, a semiconductor device is provided. The semiconductor device includes a voltage generation circuit and an internal circuit. The voltage generation circuit generates a drive voltage whose level is controlled according to a voltage difference between a first node whose voltage level is controlled by a first internal current and a second node. The voltage generation circuit controls an amount of charge supplied to the first and second nodes from a power supply voltage terminal according to a level of the drive voltage to generate a supply voltage. The internal circuit operates in response to the supply voltage.

According to yet another embodiment, there is provided a method of generating a voltage. The method includes generating a drive voltage whose level is controlled according to a voltage difference between a first node and a second node. A voltage level of the first node is controlled by a first internal current. An amount of charge supplied to the first and second nodes from a power supply voltage terminal is controlled according to a level of the drive voltage to generate a supply voltage.

BRIEF DESCRIPTION OF THE DRAWINGS

Various embodiments of an inventive concept will become more apparent in view of the attached drawings and accompanying detailed description, in which.

DETAILED DESCRIPTION OF THE EMBODIMENTS

Various embodiments of the present disclosure will be described hereinafter with reference to the accompanying drawings. However, the embodiments described herein are for illustrative purposes only and are not intended to limit the scope of the present disclosure.

Figure 1:
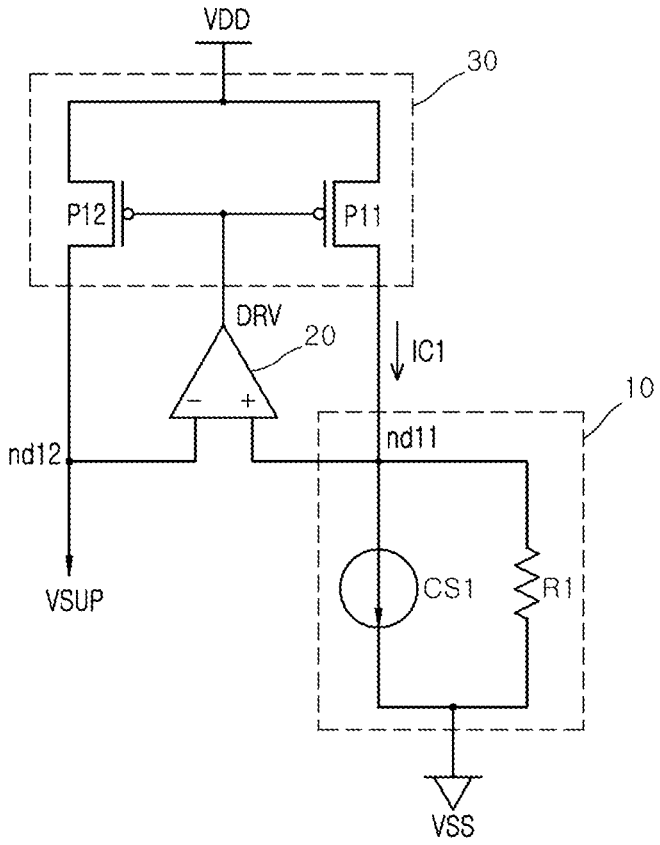
FIG. 1 is a circuit diagram illustrating a voltage generation circuit according to an embodiment.

As illustrated in FIG. 1, a voltage generation circuit according to an embodiment may include a current source 10, a comparison circuit 20 and a charge supply circuit 30.

The current source 10 may be connected to a node nd11 to generate a first internal current IC1 corresponding to a constant current. The current source 10 may include a first current source CS1 and a first resistor R1. The current source 10 may be connected between the node nd11 and a ground voltage VSS terminal. The first current source CS1 and the first resistor R1 may be connected in parallel between the node nd11 and the ground voltage VSS terminal.

The comparison circuit 20 may compare a voltage of the node nd11 with a voltage of a node nd12 to generate a drive voltage DRV. The comparison circuit 20 may compare a voltage of the node nd11 with a voltage of the node nd12 to generate the drive voltage DRV whose level is controlled according to a voltage difference between the voltage of the node nd11, whose voltage level is controlled by the first internal current IC1, and the voltage of the node nd12. A level of the drive voltage DRV may increase if the voltage of the node nd11 is higher than the voltage of the node nd12. A level of the drive voltage DRV may be lowered if the voltage of the node nd11 is lower than the voltage of the node nd12.

The charge supply circuit 30 may control an amount of charge supplied to the nodes nd11 and nd12 from a power supply voltage VDD terminal according to a level of the drive voltage DRV to generate a supply voltage VSUP. For example, while the supply voltage VSUP is generated, the charge supply circuit 30 may increase the amount of charge supplied to the nodes nd11 and nd12 if the voltage of the node nd12 is higher than the voltage of the node nd11. In another example, while the supply voltage VSUP is generated, the charge supply circuit 30 may reduce the amount of charge supplied to the nodes nd11 and nd12 if the voltage of the node nd12 is lower than a voltage of the node nd11. The charge supply circuit 30 may include a first drive element P11 and a second drive element P12. The charge supply circuit 30 may be configured so that the first internal current IC1 generated by the current source 10 flows through the first drive element P11. The first drive element P11 may be realized using a PMOS transistor which is connected between the power supply voltage VDD terminal and the node nd11. The first drive element P11 may control an amount of charge supplied to the node nd11 from the power supply voltage VDD terminal according to a level of the drive voltage DRV. The first drive element P11 may increase an amount of charge supplied to the node nd11 from the power supply voltage VDD terminal if a level of the drive voltage DRV is relatively low. The first drive element P11 may reduce an amount of charge supplied to the node nd11 from the power supply voltage VDD terminal if a level of the drive voltage DRV is relatively high. The charge supply circuit 30 may be realized so that a mirror current having the same amount of current as the first internal current IC1 flowing through the first drive element P11 flows through the second drive element P12. The second drive element P12 may be realized using a PMOS transistor which is connected between the power supply voltage VDD terminal and the node nd12. The second drive element P12 may control an amount of charge supplied to the node nd12 from the power supply voltage VDD terminal according to a level of the drive voltage DRV. The second drive element P12 may increase an amount of charge supplied to the node nd12 from the power supply voltage VDD terminal if a level of the drive voltage DRV is relatively low. The second drive element P12 may reduce an amount of charge supplied to the node nd12 from the power supply voltage VDD terminal if a level of the drive voltage DRV is relatively high. The charge supply circuit 30 may generate the supply voltage VSUP according to an amount of charge supplied to the node nd12. The supply voltage VSUP may be generated to have a voltage that is reduced by a voltage drop across the second drive element P12 from the power supply voltage VDD. A magnitude of the voltage drop across the second drive element P12 may be set to be less than a saturation voltage of the transistors constituting an internal circuit 200 illustrated in FIG. 4.

An output impedance value Ros of the node nd12 through which the supply voltage VSUP of FIG. 1 is outputted may be expressed by the following equation 1.

$$Ros = \frac{1 + gm1Ao/(go1 + goB)}{go2[1 + gm1Ao/(go1 + goB)] - gm2Ao} \quad \text{(Equation 1)}$$

where, "gm1" denotes a transconductance of the first drive element P11, "gm2" denotes a transconductance of the second drive element P12, "Ao" denotes a gain of the comparison circuit 20, "go1" denotes a conductance of the first drive element P11, "go2" denotes a conductance of the second drive element P12, and "goB" denotes a conductance of the current source 10.

The output impedance value Ros of the node nd12 may be controlled to be identical to an output impedance of the current source 10 if the nodes nd11 and nd12 are adjusted to have the same voltage according to operations of the comparison circuit 20 and the charge supply circuit 30.

Figure 2:
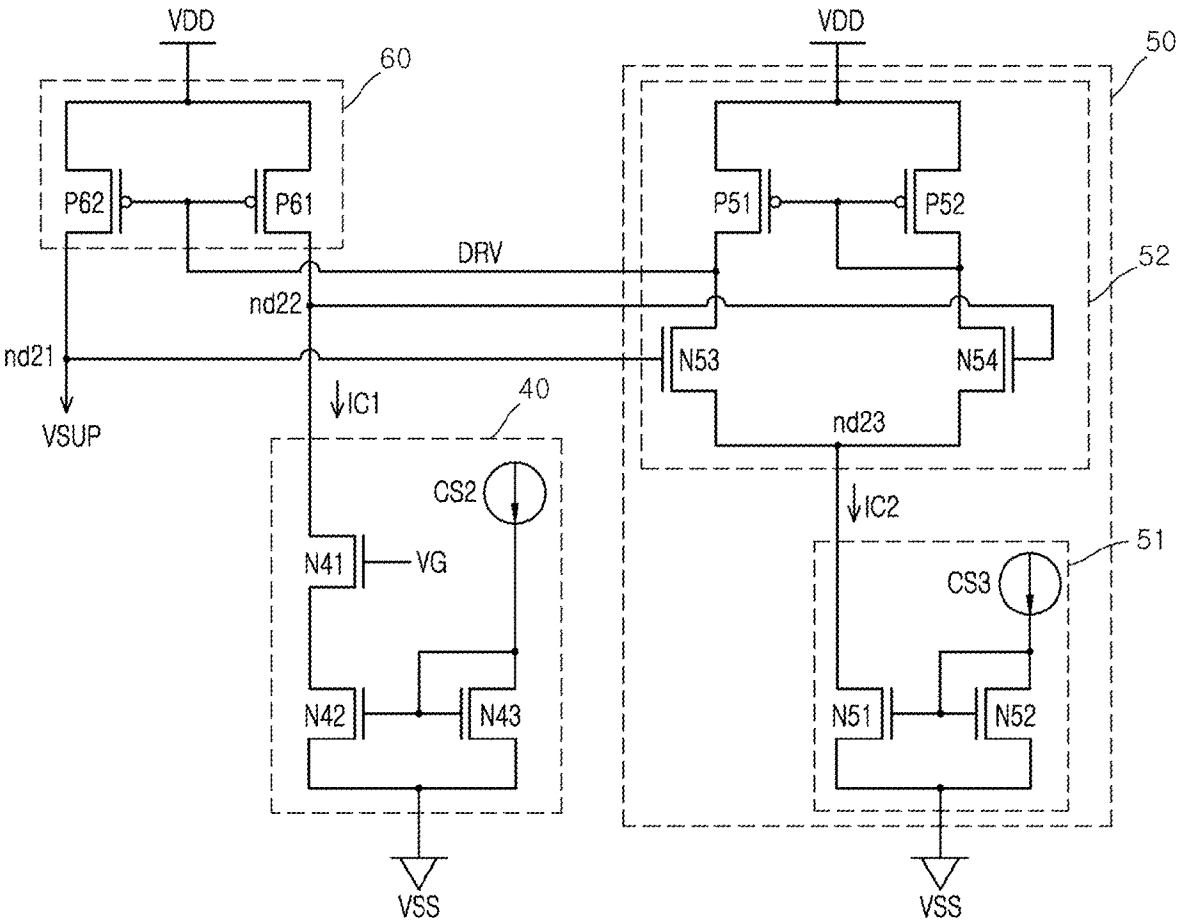
FIG. 2 is a circuit diagram illustrating a voltage generation circuit according to another embodiment.

As illustrated in FIG. 2, a voltage generation circuit according to another embodiment may include a current source 40, a comparison circuit 50, and a charge supply circuit 60.

The current source 40 may be connected to a node nd22 to generate a first internal current IC1 corresponding to a constant current. The current source 40 may include NMOS transistors N41, N42 and N43 and a second current source CS2. The NMOS transistors N41 and N42 may be connected in series between the node nd22 and a ground voltage VSS terminal to set a resistance value of the current source 40. The NMOS transistor N41 may be turned on in response to a gate voltage VG. The gate voltage VG may be set to have a voltage level for turning on the NMOS transistor N41. Gates of the NMOS transistors N42 and N43 may be connected to each other to provide a current mirror including the NMOS transistors N42 and N43. The NMOS transistor N43 may be connected between the second current source CS2 and the ground voltage VSS terminal, and the gate of the NMOS transistor N43 may also be connected to the second current source CS2. The resistance value of the NMOS transistors N41 and N42 may be set to correspond to a resistance value of the resistor R1 illustrated in FIG. 1. The second current source CS2 and the NMOS transistor N43 may correspond to the first current source CS1 of FIG. 1.

The comparison circuit 50 may include an internal current source 51 and a drive voltage generation circuit 52.

The internal current source 51 may be connected to a node nd23 to generate a second internal current IC2 corresponding to a constant current. The internal current source 51 may include a third current source CS3 and NMOS transistors N51 and N52. The NMOS transistor N51 may be connected between the node nd23 and the ground voltage VSS terminal, and a gate of the NMOS transistor N51 may be connected to a gate of the NMOS transistor N52. The NMOS transistor N52 may be connected between the third current source CS3 and the ground voltage VSS terminal, and the gate of the NMOS transistor N52 may be connected to the third current source CS3. The gates of the NMOS transistors N51 and N52 may be connected to each other to provide a current mirror including the NMOS transistors N51 and N52.

The drive voltage generation circuit 52 may generate a drive voltage DRV whose level is controlled according to the second internal current IC2 and a voltage difference between a node nd21 and the node nd22. The drive voltage generation circuit 52 may be connected between a power supply voltage VDD terminal and the node nd23. The drive voltage generation circuit 52 may include PMOS transistors P51 and P52 and NMOS transistors N53 and N54. The drive voltage generation circuit 52 may be realized using a general comparator.

The comparison circuit 50 may compare the voltage of the node nd21 with the voltage of the node nd22 to generate the drive voltage DRV. The comparison circuit 50 may compare the voltage of the node nd21 with the voltage of the node nd22 to generate the drive voltage DRV whose level is controlled according to a voltage difference between the voltage of the node nd21 and the voltage of the node nd22, whose voltage level is controlled by the first internal current IC1. A level of the drive voltage DRV may be lowered if the voltage of the node nd21 is higher than the voltage of the node nd22. A level of the drive voltage DRV may increase if the voltage of the node nd21 is lower than the voltage of the node nd22. The comparison circuit 50 may correspond to the comparison circuit 20 of FIG. 1.

The charge supply circuit 60 may control an amount of charge supplied to the nodes nd21 and nd22 from the power supply voltage VDD terminal according to a level of the drive voltage DRV to generate a supply voltage VSUP. For example, while the supply voltage VSUP is generated, the charge supply circuit 60 may increase the amount of charge supplied to the nodes nd21 and nd22 if the voltage of the node nd21 is higher than the voltage of the node nd22. In another example, while the supply voltage VSUP is generated, the charge supply circuit 60 may reduce the amount of charge supplied to the nodes nd21 and nd22 if the voltage of the node nd21 is lower than a voltage of the node nd22. The charge supply circuit 60 may include a third drive element P61 and a fourth drive element P62. The charge supply circuit 60 may be configured so that the first internal current IC1 generated by the current source 40 flows through the third drive element P61. The third drive element P61 may be realized using a PMOS transistor which is connected between the power supply voltage VDD terminal and the node nd22. The third drive element P61 may control an amount of charge supplied to the node nd22 from the power supply voltage VDD terminal according to a level of the drive voltage DRV. The third drive element P61 may increase an amount of charge supplied to the node nd22 from the power supply voltage VDD terminal if a level of the drive voltage DRV is lowered. The third drive element P61 may reduce an amount of charge supplied to the node nd22 from the power supply voltage VDD terminal if a level of the drive voltage DRV increases. The charge supply circuit 60 may be realized so that a mirror current having the same amount of current as the first internal current IC1 flowing through the third drive element P61 flows through the fourth drive element P62. The fourth drive element P62 may be realized using a PMOS transistor which is connected between the power supply voltage VDD terminal and the node nd21. The fourth drive element P62 may control an amount of charge supplied to the node nd21 from the power supply voltage VDD terminal according to a level of the drive voltage DRV. The fourth drive element P62 may increase an amount of charge supplied to the node nd21 from the power supply voltage VDD terminal if a level of the drive voltage DRV is lowered. The fourth drive element P62 may reduce an amount of charge supplied to the node nd21 from the power supply voltage VDD terminal if a level of the drive voltage DRV increases. The charge supply circuit 60 may generate the supply voltage VSUP according to an amount of charge supplied to the node nd21. The charge supply circuit 60 may correspond to the charge supply circuit 30 illustrated in FIG. 1.

Figure 3:
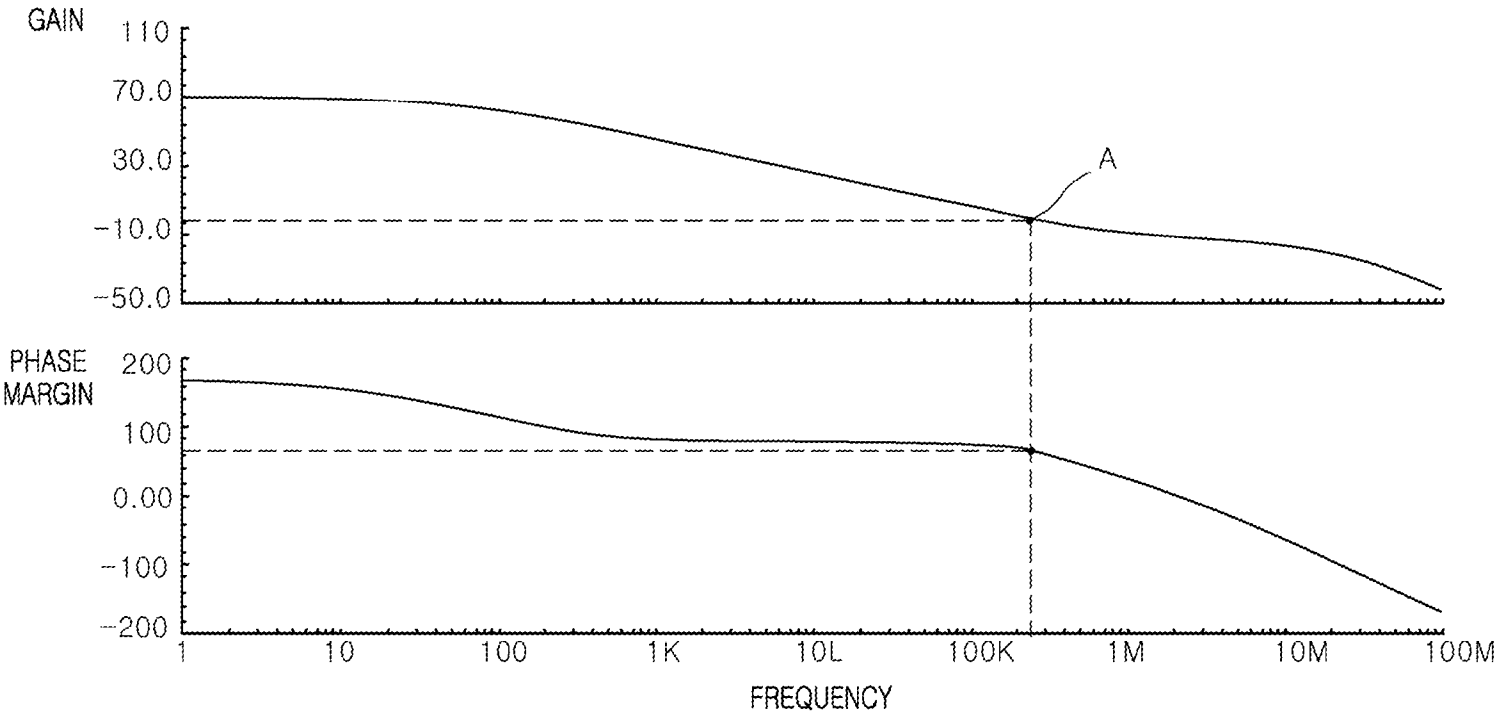
FIG. 3 is a combined graph illustrating a gain of a comparison circuit and a phase margin of a supply voltage as a function of a frequency in voltage generation circuits according to some embodiments.

FIG. 3 is a combined graph illustrating a gain of a comparison circuit and a phase margin of a supply voltage as a function of a frequency in voltage generation circuits according to some embodiments.

In the graph of FIG. 3, the phase margin of the supply voltage may measure 73.4962 when the gain of the comparison circuit is 0 dB (see the point "A"). That is, according to the charge supply circuit 30 illustrated in FIG. 1 or the charge supply circuit 60 illustrated in FIG. 2, a level variation of the power supply voltage VDD may be compensated by an operation of the comparison circuit (20 of FIG. 1 or 40 of FIG. 2) to generate the supply voltage VSUP having a constant level.

An operation of a voltage generation circuit according to an embodiment will be described hereinafter with reference to FIG. 1 in conjunction with an example in which a voltage of the node nd11 is lower than a voltage of the node nd12 with a decrease in the power supply voltage VDD and an example in which a voltage of the node nd11 is higher than a voltage of the node nd12 with an increase in the power supply voltage VDD.

First, the operation of the voltage generation circuit will be described hereinafter in conjunction with an example in which a voltage of the node nd11 is lower than a voltage of the node nd12 with a decrease in the power supply voltage VDD.

The current source 10 may be connected to the node nd11 to generate the first internal current IC1 corresponding to a constant current.

A voltage of the node nd11 may be reduced to be lower than the power supply voltage VDD because of a voltage drop across the first drive element P11, which is caused by the first internal current IC1 flowing through the first drive element P11. A voltage of the node nd12 may also be reduced to be lower than the power supply voltage VDD because of a voltage drop across the second drive element P12, which is caused by a mirror current (having the same amount of current as the first internal current IC1) flowing through the second drive element P12. In such a case, a voltage of the node nd11 may be generated to be lower than a voltage of the node nd12.

The comparison circuit 20 may compare a voltage of the node nd11, a level of which is controlled by the first internal current IC1, with a voltage of the node nd12 to generate the drive voltage DRV whose level is lowered.

The first drive element P11 of the charge supply circuit 30 may increase an amount of charge supplied to the node nd11 from the power supply voltage VDD terminal because a level of the drive voltage DRV is lowered. The second drive element P12 of the charge supply circuit 30 may also increase an amount of charge supplied to the node nd12 from the power supply voltage VDD terminal because a level of the drive voltage DRV is lowered.

A level of the supply voltage VSUP may increase because an amount of charge supplied to the node nd12 from the power supply voltage VDD terminal increases. An increase in an amount of charge supplied to the node nd12 means a decrease of a voltage drop across the second drive element P12 coupled between the power supply voltage VDD terminal and the node nd12. That is, even though a level of the power supply voltage VDD is lowered, the voltage drop across the second drive element P12 may be reduced so that the supply voltage VSUP still maintains a constant level.

Next, operation of the voltage generation circuit will be described hereinafter in conjunction with an example in which a voltage of the node nd11 is higher than a voltage of the node nd12 with an increase in the power supply voltage VDD.

The current source 10 may be connected to the node nd11 to generate the first internal current IC1 corresponding to a constant current.

A voltage of the node nd11 may be reduced to be lower than the power supply voltage VDD because of a voltage drop across the first drive element P11, which is caused by the first internal current IC1 flowing through the first drive element P11. A voltage of the node nd12 may also be reduced to be lower than the power supply voltage VDD because of a voltage drop across the second drive element P12, which is caused by a mirror current (having the same amount of current as the first internal current IC1) flowing through the second drive element P12. In such a case, a voltage of the node nd11 may be generated to be higher than a voltage of the node nd12.

The comparison circuit 20 may compare a voltage of the node nd11, a level of which is controlled by the first internal current IC1, with a voltage of the node nd12 to generate the drive voltage DRV whose level may increase.

The first drive element P11 of the charge supply circuit 30 may reduce an amount of charge supplied to the node nd11 from the power supply voltage VDD terminal because a level of the drive voltage DRV increases. The second drive element P12 of the charge supply circuit 30 may also reduce an amount of charge supplied to the node nd12 from the power supply voltage VDD terminal because a level of the drive voltage DRV increases.

A level of the supply voltage VSUP may be lowered because an amount of charge supplied to the node nd12 from the power supply voltage VDD terminal is reduced. Decrease of an amount of charge supplied to the node nd12 means an increase of a voltage drop across the second drive element P12 coupled between the power supply voltage VDD terminal and the node nd12. That is, even though a level of the power supply voltage VDD increases, the voltage drop across the second drive element P12 may increase so that the supply voltage VSUP still maintains a constant level.

The voltage generation circuit according to an embodiment may repeatedly and continuously perform the aforementioned operations to generate the supply voltage VSUP having a constant level, even though a level of the power supply voltage VDD fluctuates.

As described above, a voltage generation circuit according to an embodiment may control an amount of charge supplied to two different nodes from a power supply voltage terminal according to a voltage difference between the two different nodes, while the power supply voltage fluctuates. Accordingly, the voltage generation circuit may compensate for voltage variation of the nodes to generate a supply voltage having a constant level.

Figure 4:
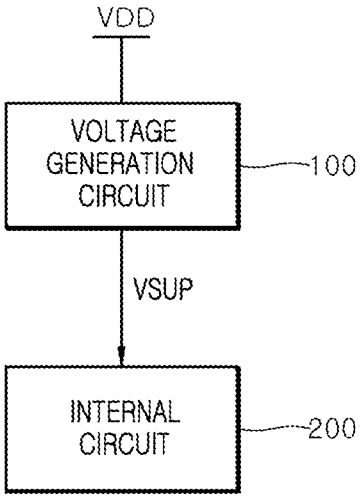
FIG. 4 is a block diagram illustrating a semiconductor device according to an embodiment.

FIG. 4 is a block diagram illustrating a semiconductor device according to an embodiment.

As illustrated in FIG. 4, the semiconductor device may include a voltage generation circuit 100 and an internal circuit 200.

The voltage generation circuit 100 may generate a drive voltage (DRV of FIG. 1 or 2) whose level is controlled according to a voltage difference between a node (nd11 of FIG. 1 or nd21 of FIG. 2) whose voltage level is controlled by a first internal current (IC1 of FIG. 1 or 2) and a node (nd12 of FIG. 1 or nd22 of FIG. 2). The voltage generation circuit 100 may control an amount of charge supplied to the node (nd11 of FIG. 1 or nd21 of FIG. 2) and the node (nd12 of FIG. 1 or nd22 of FIG. 2) from a power supply voltage VDD according to a level of the drive voltage (DRV of FIG. 1 or 2) to generate a supply voltage VSUP. The voltage generation circuit 100 illustrated in FIG. 4 may be realized using the voltage generation circuit illustrated in FIG. 1 or 2.

The internal circuit 200 may be driven in response to the supply voltage VSUP. The internal circuit 200 may be realized using a general circuit including a plurality of transistors.

The semiconductor device according to an embodiment may compensate for a variation of the supply voltage according to fluctuations of the power supply voltage to generate the supply voltage having a constant level. As a result, the internal circuit of the semiconductor device may receive the constant supply voltage to perform stable operations.

Figure 5:
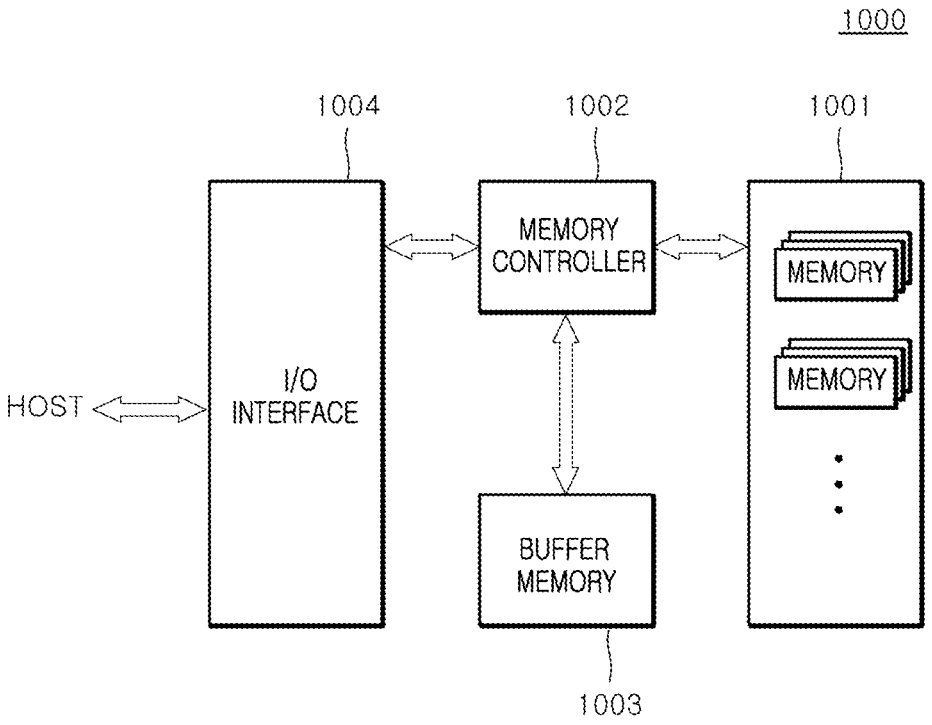
FIG. 5 is a block diagram illustrating a configuration of an electronic system employing at least one of the voltage generation circuits and the semiconductor device described with reference to FIGS. 1 to 4.

At least one of the voltage generation circuits and the semiconductor device described with reference to FIGS. 1 to 4 may be applied to an electronic system that includes a memory system, a graphic system, a computing system, a mobile system, or the like. For example, as illustrated in FIG. 5, an electronic system 1000 according an embodiment may include a data storage circuit 1001, a memory controller 1002, a buffer memory 1003, and an input/output (I/O) interface 1004.

The data storage circuit 1001 may store data which is outputted from the memory controller 1002 or may read and output stored data to the memory controller 1002, according to a control signal generated from the memory controller 1002. The data storage circuit 1001 may include the second semiconductor device illustrated in FIG. 4. Meanwhile, the data storage circuit 1001 may include a nonvolatile memory that can retain its stored data even when its power supply is interrupted. The nonvolatile memory may be a flash memory such as a NOR-type flash memory or a NAND-type flash memory, a phase change random access memory (PRAM), a resistive random access memory (RRAM), a spin transfer torque random access memory (STTRAM), a magnetic random access memory (MRAM), or the like.

The memory controller 1002 may receive a command outputted from an external device (e.g., a host device) through the I/O interface 1004 and may decode the command outputted from the host device to control an operation for inputting data into the data storage circuit 1001 or the buffer memory 1003 or for outputting data stored in the data storage circuit 1001 or the buffer memory 1003. Although FIG. 5 illustrates the memory controller 1002 with a single block, the memory controller 1002 may include one controller for controlling the data storage circuit 1001 comprised of a nonvolatile memory and another controller for controlling the buffer memory 1003 comprised of a volatile memory.

The buffer memory 1003 may temporarily store the data which is processed by the memory controller 1002. That is, the buffer memory 1003 may temporarily store data which is outputted from or to be inputted to the data storage circuit 1001. The buffer memory 1003 may store data, which is outputted from the memory controller 1002, according to a control signal. The buffer memory 1003 may read and output the stored data to the memory controller 1002. The buffer memory 1003 may include a volatile memory such as a dynamic random access memory (DRAM), a mobile DRAM, or a static random access memory (SRAM).

The I/O interface 1004 may physically and electrically connect the memory controller 1002 to the external device (i.e., the host). Thus, the memory controller 1002 may receive control signals and data supplied from the external device (i.e., the host) through the I/O interface 1004 and may output the data generated from the memory controller 1002 to the external device (i.e., the host) through the I/O interface 1004. That is, the electronic system 1000 may communicate with the host through the I/O interface 1004. The I/O interface 1004 may include any one of various interface protocols such as a universal serial bus (USB) drive, a multi-media card (MMC), a peripheral component interconnect-express (PCI-E), a serial attached SCSI (SAS), a serial AT attachment (SATA), a parallel AT attachment (PATA), a small computer system interface (SCSI), an enhanced small device interface (ESDI), and an integrated drive electronics (IDE).

The electronic system 1000 may be used as an auxiliary storage device of the host or an external storage device. The electronic system 1000 may include a solid state disk (SSD), a USB drive, a secure digital (SD) card, a mini secure digital (mSD) card, a micro secure digital (micro SD) card, a secure digital high capacity (SDHC) card, a memory stick card, a smart media (SM) card, a multi-media card (MMC), an embedded multi-media card (eMMC), a compact flash (CF) card, or the like.

What is claimed is:

1. A voltage generation circuit comprising:

a current source configured to be connected to a first node and configured to generate a first internal current corresponding to a constant current;

a comparison circuit configured to generate a drive voltage whose level is controlled according to a voltage difference between the first node, whose voltage level is controlled by the first internal current, and a second node; and a charge supply circuit configured to control an amount of charge supplied to the first and second nodes from a power supply voltage terminal according to a level of the drive voltage to generate a supply voltage.

2. The voltage generation circuit of claim 1, wherein a level of the drive voltage increases if a voltage of the first node is higher than a voltage of the second node; and wherein a level of the drive voltage is lowered if a voltage of the first node is lower than a voltage of the second node.

3. The voltage generation circuit of claim 1, wherein the charge supply circuit reduces the amount of charge supplied to the first and second nodes if a voltage of the second node is lower than a voltage of the first node.

4. The voltage generation circuit of claim 1, wherein the charge supply circuit increases the amount of charge supplied to the first and second nodes if a voltage of the second node is higher than a voltage of the first node.

5. The voltage generation circuit of claim 1, wherein the charge supply circuit generates the supply voltage according to the amount of charge supplied to the second node.

6. The voltage generation circuit of claim 1, wherein the comparison circuit includes:

an internal current source configured to be connected to a third node and configured to generate a second internal current corresponding to a constant current; and a drive voltage generation circuit configured to be connected between the power supply voltage terminal and the third node, and configured to generate the drive voltage whose level is controlled according to the second internal current and according to a voltage difference between the first node and the second node.

7. The voltage generation circuit of claim 1, wherein the charge supply circuit includes:

a first drive element coupled between the power supply voltage terminal and the first node to control the amount of charge supplied to the first node from the power supply voltage terminal according to a level of the drive voltage; and a second drive element coupled between the power supply voltage terminal and the second node to control the amount of charge supplied to the second node from the power supply voltage terminal according to a level of the drive voltage.

8. A semiconductor device comprising:

a voltage generation circuit configured to generate a drive voltage whose level is controlled according to a voltage difference between a first node, whose voltage level is controlled by a first internal current, and a second node, and configured to control an amount of charge supplied to the first and second nodes from a power supply voltage terminal according to a level of the drive voltage to generate a supply voltage; and an internal circuit configured to operate in response to the supply voltage.

9. The semiconductor device of claim 8, wherein a level of the drive voltage increases if a voltage of the first node is higher than a voltage of the second node; and wherein a level of the drive voltage is lowered if a voltage of the first node is lower than a voltage of the second node.

10. The semiconductor device of claim 8, wherein the voltage generation circuit includes:

a current source configured to be connected to the first node and configured to generate a first internal current corresponding to a constant current;

a comparison circuit configured to compare a voltage of the first node, a level of which is controlled according to the first internal current, with a voltage of the second node to generate the drive voltage; and a charge supply circuit configured to control an amount of charge supplied to the first and second nodes from the power supply voltage terminal according to a level of the drive voltage to generate the supply voltage.

11. The semiconductor device of claim 10, wherein the charge supply circuit generates the supply voltage according to the amount of charge supplied to the second node.

12. The semiconductor device of claim 10, wherein the charge supply circuit reduces the amount of charge supplied to the first and second nodes if a voltage of the second node is lower than a voltage of the first node.

13. The semiconductor device of claim 10, wherein the charge supply circuit increases the amount of charge supplied to the first and second nodes if a voltage of the second node is higher than a voltage of the first node.

14. The semiconductor device of claim 10, wherein the comparison circuit includes:

an internal current source configured to be connected to a third node and configured to generate a second internal current corresponding to a constant current; and a drive voltage generation circuit configured to be connected between the power supply voltage terminal and the third node, and configured to generate the drive voltage whose level is controlled according to the second internal current and according to a voltage difference between the first node and the second node.

15. The semiconductor device of claim 10, wherein the charge supply circuit includes:

a first drive element coupled between the power supply voltage terminal and the first node to control the amount of charge supplied to the first node from the power supply voltage terminal according to a level of the drive voltage; and a second drive element coupled between the power supply voltage terminal and the second node to control the amount of charge supplied to the second node from the power supply voltage terminal according to a level of the drive voltage.

16. A method of generating a voltage, the method comprising:

generating a drive voltage whose level is controlled according to a voltage difference between a first node, whose voltage level is controlled by a first internal current, and a second node; and controlling an amount of charge supplied to the first and second nodes from a power supply voltage terminal according to a level of the drive voltage to generate a supply voltage.

17. The method of claim 16, wherein a level of the drive voltage increases if a voltage of the first node is higher than a voltage of the second node; and wherein a level of the drive voltage is lowered if a voltage of the first node is lower than a voltage of the second node.

18. The method of claim 16, wherein while the supply voltage is generated, the amount of charge supplied to the first and second nodes is reduced if a voltage of the second node is lower than a voltage of the first node.

19. The method of claim 16, wherein while the supply voltage is generated, the amount of charge supplied to the first and second nodes increases if a voltage of the second node is higher than a voltage of the first node.

20. The method of claim 16, wherein the supply voltage is generated according to the amount of charge supplied to the second node.

* * * * *